US010496038B2

(12) United States Patent
Stranczl et al.

(10) Patent No.: US 10,496,038 B2
(45) Date of Patent: Dec. 3, 2019

(54) PROTECTION OF A TIMEPIECE COMPONENT MADE OF MICROMACHINABLE MATERIAL

(71) Applicant: Nivarox-FAR S.A., Le Locle (CH)

(72) Inventors: Marc Stranczl, Nyon (CH); Daniel Mallet, Le Bélieu (FR)

(73) Assignee: Nivarox-FAR S.A., Le Locle (CH)

( * ) Notice: Subject to any disclaimer, the term of this patent is extended or adjusted under 35 U.S.C. 154(b) by 377 days.

(21) Appl. No.: 15/299,033

(22) Filed: Oct. 20, 2016

(65) Prior Publication Data

US 2017/0160701 A1 Jun. 8, 2017

(30) Foreign Application Priority Data

Dec. 2, 2015 (EP) ..... 15197589

(51) Int. Cl.

| | |
|---|---|
| ***G04B 31/004*** | (2006.01) |
| ***G04B 31/06*** | (2006.01) |
| ***G04B 13/02*** | (2006.01) |
| ***G04B 29/04*** | (2006.01) |

(52) U.S. Cl.

CPC ..... *G04B 31/004* (2013.01); *G04B 13/02* (2013.01); *G04B 29/04* (2013.01); *G04B 31/06* (2013.01)

(58) Field of Classification Search

CPC ..... G04B 13/022; G04B 29/04; G04B 31/00; G04B 31/004; G04B 31/06

See application file for complete search history.

(56) References Cited

U.S. PATENT DOCUMENTS

| | | | | |
|---|---|---|---|---|
| 2013/0047437 | A1 | 2/2013 | Daout | |
| 2014/0064046 | A1 * | 3/2014 | Amano | G04B 19/042 368/238 |
| 2014/0160901 | A1 | 6/2014 | Cusin et al. | |
| 2014/0160902 | A1 * | 6/2014 | Cusin | G04B 13/022 368/140 |

(Continued)

FOREIGN PATENT DOCUMENTS

| | | | | |
|---|---|---|---|---|
| EP | 2469358 | A2 * | 6/2012 | G04B 37/066 |
| EP | 2 743 782 | A1 | 6/2014 | |

(Continued)

OTHER PUBLICATIONS

European Search Report dated Jun. 23, 2016, Corresponds to EP 15 19 7589 (5 pages).

*Primary Examiner* — Daniel P Wicklund
(74) *Attorney, Agent, or Firm* — Sughrue Mion, PLLC

(57) ABSTRACT

Timepiece sub-assembly including a component made of micromachinable material including an attachment area with a peripheral contact surface, and a shell element deformable between two shapes, one contracted and one expanded, arranged to hold the attachment area inside a housing with at least one degree of freedom, and which includes a complementary contact surface arranged, in its contracted shape, to exert a clamping force on the contact surface and to securely immobilise the attachment area in all directions, the shell element including a first element and a second element that are movable with respect to each other in its expanded shape, each including a complementary contact surface, and including clamping means for holding the first and second elements clamped together in its contracted shape.

17 Claims, 3 Drawing Sheets

(56) References Cited

U.S. PATENT DOCUMENTS

| | | | | |
|---|---|---|---|---|
| 2014/0226447 | A1* | 8/2014 | Lagorgette ..... | G04B 17/20<br>368/127 |
| 2016/0274541 | A1* | 9/2016 | Amano ..... | G04B 19/12 |

FOREIGN PATENT DOCUMENTS

| | | | |
|---|---|---|---|
| EP | 2 755 093 | A2 | 7/2014 |
| WO | 2011/116486 | A1 | 9/2011 |

* cited by examiner

PROTECTION OF A TIMEPIECE COMPONENT MADE OF MICROMACHINABLE MATERIAL

This application claims priority from European Patent Application No 15197589.3 of Dec. 2, 2015, the entire disclosure of which is hereby incorporated herein by reference.

FIELD OF THE INVENTION

The invention concerns a timepiece sub-assembly comprising, on the one hand, a timepiece component made of micromachinable material comprising at least one attachment area, and on the other hand, a shell element arranged to surround said attachment area, said attachment area comprising at least one peripheral contact surface, and said shell element being deformable with a geometry varying between a contracted shape and at least one expanded shape, and arranged to hold said attachment area inside a housing contained in said shell element, and said shell element comprising at least one complementary contact surface arranged, in said contracted shape of said shell element, to exert a clamping force on said at least one peripheral contact surface and to firmly immobilise said attachment area inside said shell element in all directions.

The invention also concerns a timepiece assembly, including at least one receiving component and at least one such sub-assembly.

The invention concerns a timepiece movement including at least one such assembly.

The invention concerns a watch including at least one such assembly.

The invention concerns the field of timepiece mechanisms comprising components made of micromachinable materials.

BACKGROUND OF THE INVENTION

It is always difficult to assemble micromachinable components to conventional mechanical components in timepiece mechanisms due to sensitivity to shear stress.

EP Patent 2755093 in the name of MASTER DYNAMIC discloses a balance spring collet for a press fit with the shoulder of a timepiece balance wheel, the collet comprising elastically deformable arms, forming an annular space and together delimiting an aperture, each arm comprising a curved concave engagement portion for engagement with such a shoulder, all of the same radius of curvature and equidistant from the central axis, in the free state at a first distance, less than the radius of the shoulder. These engagement portions have a radius of curvature such that, upon deformation of the arm portions, and engagement with the outer surface of the shoulder, the engagement portions substantially conform with the outer surface of the shoulder, and the press fit induced stresses are transferred to and distributed in the arms, so as to prevent any relative movement between the collet and the shoulder upon application of a return force from the balance spring.

EP Patent Application 2743782 A1 in the name of NIVAROX-FAR SA discloses, for timepiece components, a system of assembling a member made of a first material in the aperture of a part made of a second material having no plastic range, using an intermediate portion made of a third material, mounted between said member and said part. This part is received against a first level of the intermediate portion and is resiliently locked on a second level of the intermediate portion by the member in order to make integral the assembly of the member-intermediate portion-part.

SUMMARY OF THE INVENTION

The invention proposes to ensure the proper assembly of micromachinable components to conventional mechanical components.

To this end, the invention concerns a timepiece sub-assembly according to claim 1.

The invention also concerns a timepiece assembly, including at least one receiving component and at least one such sub-assembly.

The invention concerns a timepiece movement including at least one such assembly.

The invention concerns a watch including at least one such assembly.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
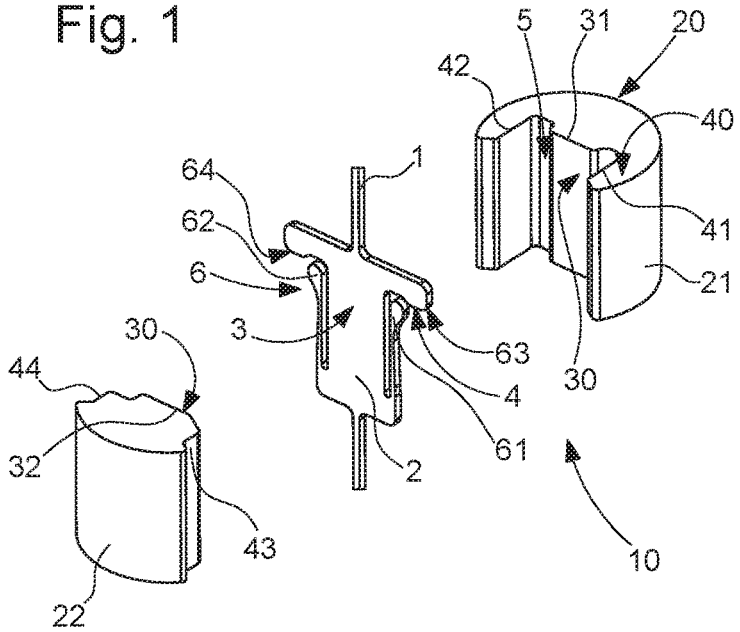
FIG. 1 shows a schematic exploded view of a sub-assembly according to a preferred variant of the invention, comprising a shell element in two parts arranged to envelop a component made of micromachinable material, in a local area arranged for such purpose.

The invention concerns a timepiece sub-assembly 10 which comprises, on the one hand, at least one timepiece component 1 made of micromachinable material, and on the other hand, a protective shell element arranged to surround one portion of this component 1.

"Micromachinable material" broadly means any material for obtaining timepiece components made of silicon, silicon oxide, DLC, amorphous material, ceramic, or suchlike, and particularly through the implementation of methods such as MEMS or LIGA, now well known to those skilled in the art. It has been possible to achieve considerable progress in watchmaking, owing to the particularly advantageous features of components made of these materials with these methods: perfect reproducibility, high geometric precision, good, durable elastic characteristics, and it is now possible to produce components of very small dimensions in a repetitive manner. In particular, the fabrication of balance springs, pallet-levers, escape wheels, jumper springs, and balances is well mastered. These technologies also make it possible to reduce in the number of components in an assembly, since they are well suited to the production of one-piece components comprising flexible connections, articulated connections, suspended elements, or suchlike. The production of entirely new types of components has thus also been made possible: this is the case of the very particular, non-limiting application, illustrated by the Figures, to a torsion wire of rectangular cross-section, used as a return element in a balance wheel oscillator. There are, however, limitations on implementation, in particular the difficulty or impossibility of creating shapes in relief and low shear resistance, which limits the application of such components to functions where they are subjected to compression, elongation or torsion stresses. Consequently, holding these components may be difficult in some configurations.

The invention proposes, in particular, to prevent any damage to micromachinable components during mounting in a sub-assembly.

This is why the invention associates a component 1 with an at least partially enveloping shell element 20, whose purpose is to protect component 1 and to absorb in its place any stresses that present a risk of destroying component 1. Shell element 20 is similar to a clamp, which subjects component 1 only to compression forces, which cause no problem.

Preferably, component 1 comprises one area of broader dimensions than the others, which is provided for assembling component 1, and which is referred to as attachment area 2. If no area satisfies this condition, attachment area 2 is simply the section of component 1 which is located in the intended attachment area. The same component 1 may of course comprise several such attachment areas 2, which may take the form of cores.

Figure 2:
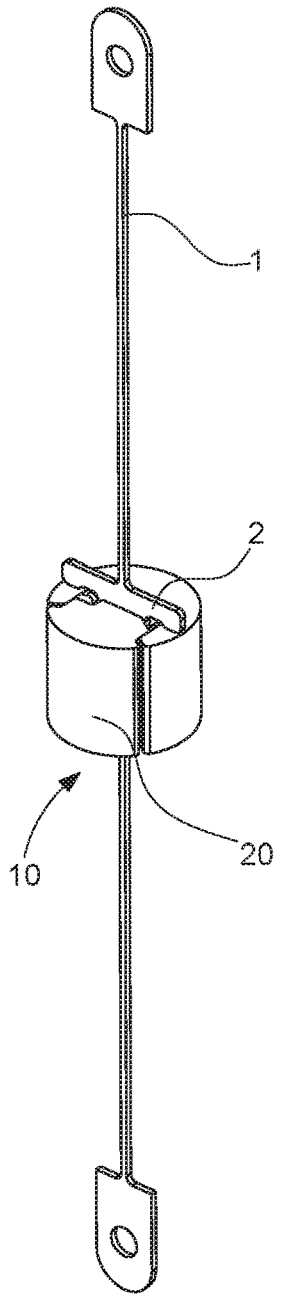
FIG. 2 represents, in a similar manner to FIG. 1, the same sub-assembly with the shell element in an contracted shape assembled around the component.
Figure 6:
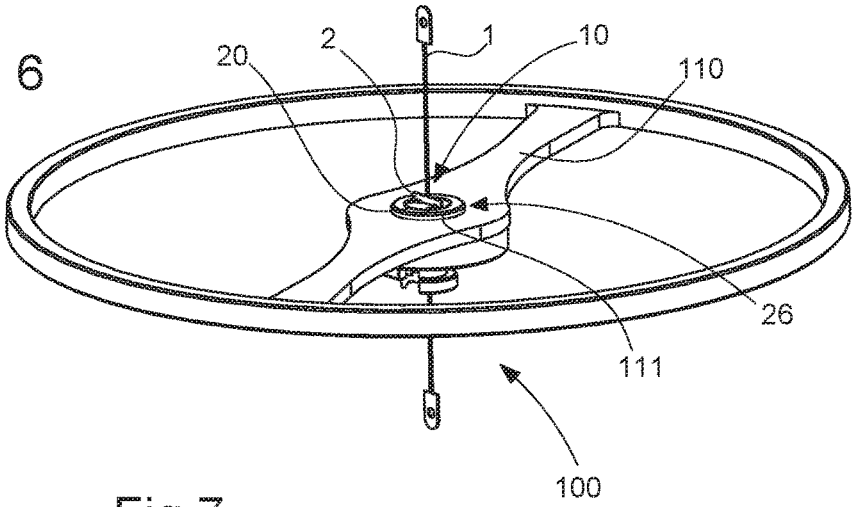
FIG. 6 represents an assembly comprising a receiving component formed by a balance wheel, inside which is housed the sub-assembly of FIGS. 1 to 4.

For example, the median portion of component 1 of FIG. 2 comprises a first attachment area 2, illustrated in more detail in FIG. 1, and which is provided for the relative attachment between a balance 110 and component 1, as seen in FIG. 6, and the end portions thereof comprise two cores 2 for the attachment and tensioning of the torsion wire formed by this particular component 1.

Figure 9:
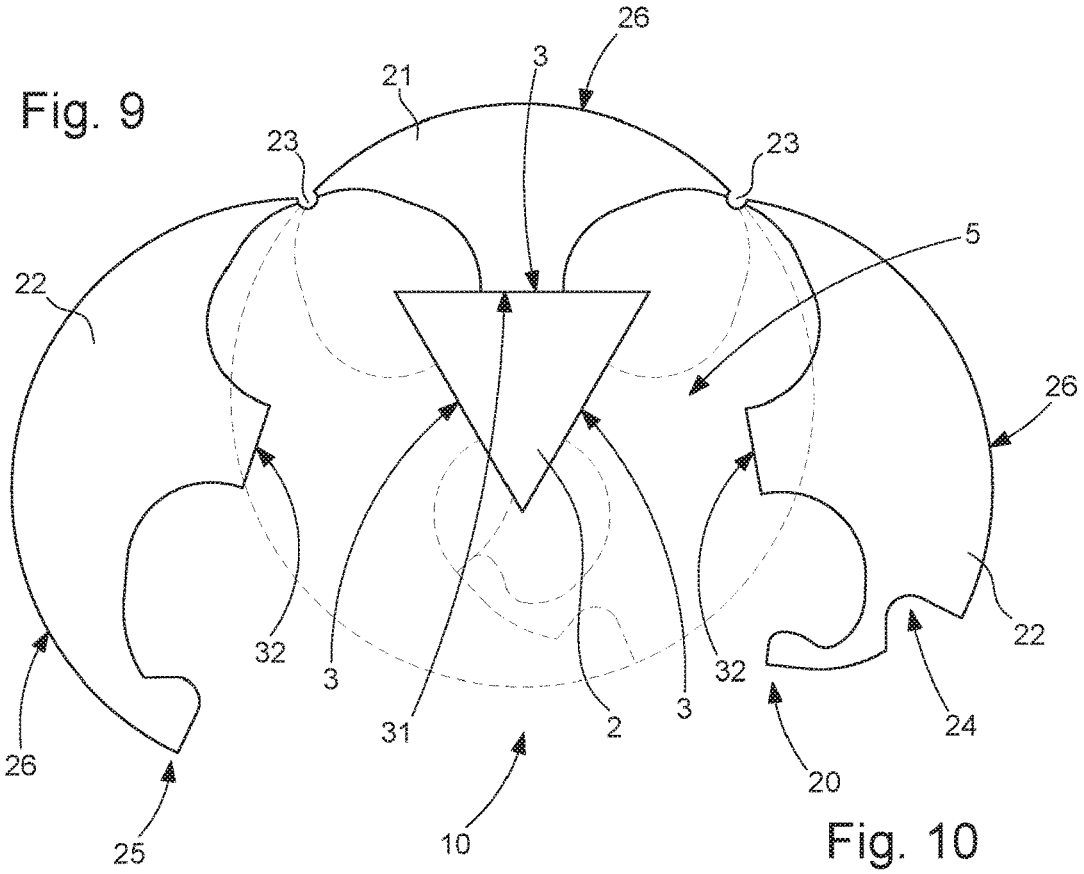
FIG. 9 shows a schematic top view of yet another sub-assembly wherein the shell element comprises three parts articulated to each other.
Figure 10:
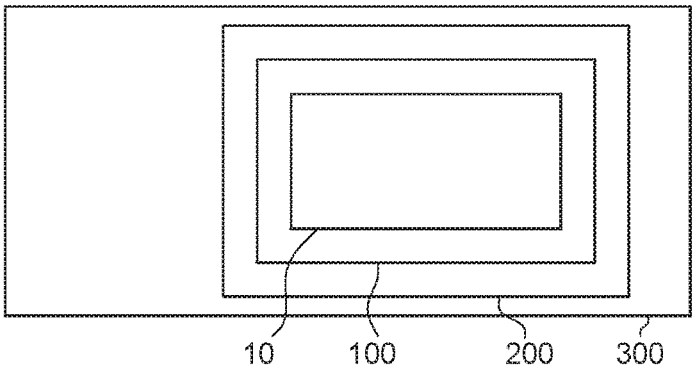
FIG. 10 is a block diagram representing a watch including a timepiece movement comprising an assembly, in turn comprising such a sub-assembly.

This attachment area 2 in turn comprises at least one peripheral contact surface 3. In a particular embodiment, attachment area 2 also comprises at least one positioning surface 4. Among the various surfaces delimiting attachment area 2, a peripheral contact surface 3 is a junction surface with shell element 20 which, according to the invention, protects component 1 in particular during the assembly thereof. For example, if attachment area 2 is cylindrical, although this shape is difficult to obtain with the aforecited methods in the current state of the art, the peripheral contact surface is a single cylindrical surface. If attachment area 2 is flat, as seen in the other Figures, it comprises two peripheral contact surfaces 3 which are preferably the largest parallel and opposite surfaces, on either side of the thinner area of attachment area 2. Other shapes of attachment area 2 are achievable, and require pressure on more than two surfaces: FIG. 9 illustrates the theory of an attachment area 2 comprising three peripheral contact surfaces 3.

Shell element 20 is arranged to hold this attachment area 2 inside a housing 5 comprised in shell element 20, with at least one degree of freedom.

To this end, shell element 20 is deformable, with a geometry varying between a contracted shape and at least one expanded shape. "Deformable" means that the shell element is dimensioned to undergo without damage the relatively small deformations caused by a press fit or similar operation. Shell element 20 is devised to allow for easy insertion of component 1 into an inner housing 5 contained in shell element 20, in an open position corresponding to an expanded shape, which is generally not an unique shape. Shell element 20 is devised to be closed around attachment area 2 of component 1, during the change from the expanded shape to the contracted shape where attachment area 2 is held under pressure. This change from one shape to the other includes a decking step, which corresponds to simply resting shell element 20 on attachment area 2 with no application of force.

Figure 4:
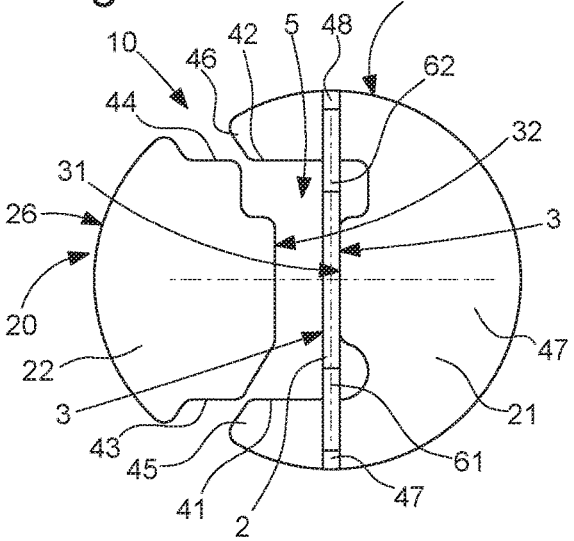
FIG. 4 shows a schematic cross-sectional view, on a substantially median plane, of the same sub-assembly, in a position where one of the two parts of the shell element approaches the other to enclose the central part of the component.
Figure 5:
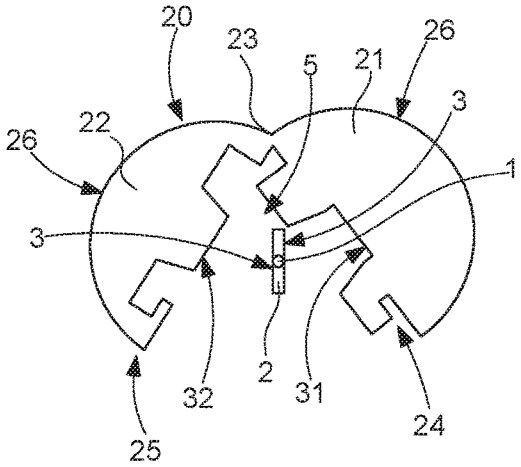
FIG. 5 represents, in a similar manner to FIG. 4, another shell element variant, in a single piece with two parts articulated to each other.

The contraction that follows this decking may be derived from an effort (force or moment) inherent to shell element 20, as in FIGS. 5 and 9 where snap-fit means ensure a force transmitted across attachment area 2, or as in FIG. 4 where the elasticity of some areas of shell element 20 both ensure that it is held in a closed position, and exert a pressure force on attachment area 2.

The contraction may also be imposed by interaction with an external component, which compresses shell element 20 around attachment area 2. This is the case of FIG. 7 where shell element 20 is an expanding clamp, of a type well known in machine tooling, forcibly held in a bore 112. The same is true of FIG. 6, where it is the insertion of shell element 20, containing component 1, into a bore 112 comprised in a receiving component 110, here a balance, which ensures the application of a centripetal force on shell element 20, which transmits a pressure force to attachment area 2, which is thus securely held.

Shell element 20 advantageously comprises at least one complementary positioning surface 40, which is arranged to cooperate with at least one positioning surface 4, for the precise positioning of attachment area 2 inside such a housing 5, with at least one degree of freedom.

Shell element 20 comprises at least one complementary contact surface 30, which is arranged, in the contracted shape of shell element 20, to exert a clamping force on this at least one peripheral contact surface 3, and to securely immobilise attachment area 2 inside shell element 20 in all directions, by applying a pressure force on attachment area 2.

Preferably, to ensure the proper positioning of attachment area 2 inside housing 5, and then to hold it in the simplest manner, shell element 20 advantageously comprises at least a first element 21 and a second element 22 which move with respect to each other in an expanded shape.

First element 21 and second element or elements 22 (for example, in the example of FIG. 9 which comprises two second elements 22) each comprise a complementary contact surface: 30, 31, 32.

Shell element 20 comprises clamping means for holding first element 21 and second element 22 or second elements 22 clamped together in the contracted shape of shell element 20.

In a particular variant, as illustrated in FIGS. 5 and 9, shell element 20 is in one-piece. First element 21 and second element(s) 22 comprised in shell element 20 are articulated to each other via articulations 23, to allow the opening of shell element 20 for the insertion or removal of a component 1, and, in the contracted shape of shell element 20, to ensure that all the components 1 comprised in sub-assembly 10 remain clamped in position in an operating position of sub-assembly 10.

In a particular variant, shell element 20 forms a sheath comprising a housing 5 for each attachment area 2 of each component 1 comprised in sub-assembly 10, each attachment area 2 being, in the expanded shape, movable in an axial direction inside its respective housing 5, and, in the contracted shape, enclosed in a substantially concentric manner inside housing 5.

In a preferred variant, as seen in FIGS. 1 to 4, where they are made in the form of cylinder portions, first element 21 and second element(s) 22 comprised in shell element 20 are independent of each other to allow the opening of shell element 20 for the insertion or removal of a component 1, and have complementary profiles to ensure that they remain clamped together in the contracted shape of shell element 20, and to ensure that all the components 1 comprised in sub-assembly 10 remain clamped in position in an operating position of sub-assembly 10.

Figure 7:
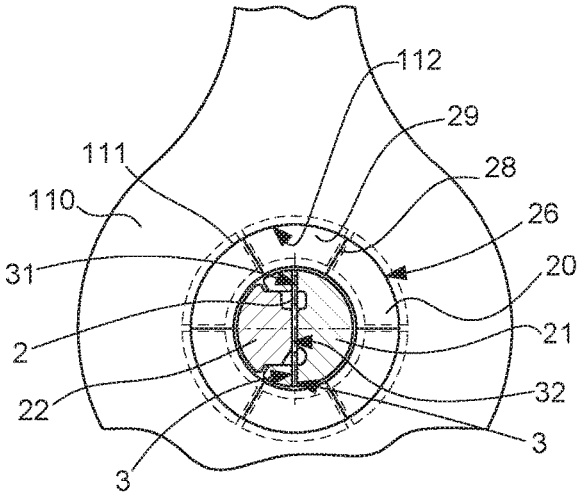
FIG. 7 shows a schematic top view of a detail of another assembly comprising a similar receiving component, inside which is housed another sub-assembly comprising a shell element forming an annular clamp around the component made of micromachinable material, this clamp being represented in the free state in dotted lines, and in the stressed state inside a bore of the receiving component in full lines.

In the variant of FIG. 7, the clamping means comprise at least one substantially annular peripheral component 29, forming a circular clamp, and arranged to clamp together at least a first element 21 and a second element 22, made here in the form of cylinder portions.

In the variants of FIGS. 5 and 9, the clamping means comprise snap-fit means 24, 25, which are arranged to clamp together the at least one first element 21 and one second element 22, on which are disposed the snap-fit means 24, 25, for example formed by beaks at the end of elastic tongues, cooperating with grooves or notches.

As seen in the variant of FIG. 7, at least the first element 21 or the second element 22 comprises at least one element 45, 46 which is more flexible than a stiffer portion 47 carrying complementary contact surface 30. This element 45, 46 forms the clamping means, in cooperation with another similar element 46, 45, or with an opposing stiff portion, and is arranged to elastically clamp the other of first element 21 or second element 22, on complementary shoulders 43, 44.

In an advantageously very simple embodiment, each attachment area 2 is plane and comprises two parallel and opposite peripheral contact surfaces 3, and each housing 5 is delimited by two complementary contact surfaces 30 which are parallel and opposite 31, 32.

Figure 3:
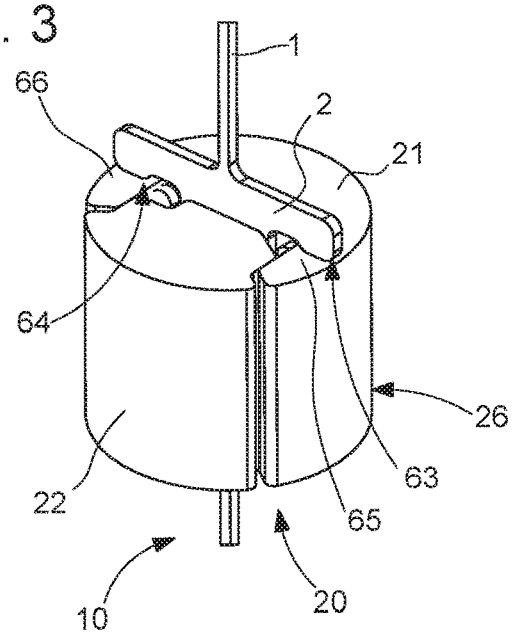
FIG. 3 is a central detail of FIG. 2, showing the cooperation of positioning means for the component and for the shell element.

In the variant illustrated in FIGS. 1 to 3, at least one attachment area 2 comprises at least one elastic arm 6 carrying a positioning surface 4 for each core. This positioning surface 4 is arranged to cooperate in a complementary manner with a complementary positioning surface 40 comprised in a stiff portion of shell element 20. These elastic arms offer better positioning and centring of the silicon part. The elastic arms may be used on bearing points 61 to 64 (in plane and out of plane positioning by flexible strip).

In the variant of FIG. 4, shall element 20 comprises, in each housing 5, stiff portions 47, 48, represented here on first element 21 carrying two complementary positioning surfaces 40 which are parallel and opposite 41, 42, forming a U-shape with the respective complementary contact surface 30. Each corresponding attachment area 2 comprises two elastic arms 6, which are symmetrical and opposite 61, 62, and which are arranged to bear under stress on complementary positioning surfaces 40, which are parallel and opposite 41, 42, at least in the contracted shape of shell element 20.

Other embodiments may naturally be employed according to the particular geometrical configuration of the components to be held together.

The invention also concerns a timepiece assembly 100, including at least one receiving component 110 and at least one such sub-assembly 10.

Receiving component 110 comprises a receiving chamber 111 for each sub-assembly 10. Inner surface 112 of each receiving chamber 111 is arranged to receive an outer surface 26 comprised in each corresponding shell element 20 of each sub-assembly 10.

Advantageously, at least one inner surface 112 of a receiving chamber 111 is dimensioned to compress the outer surface 26 of the corresponding shell element 20 upon the insertion of the corresponding sub-assembly 10 into receiving chamber 111, to cause shell element 20 to change from its expanded shape to its contracted shape upon said insertion.

Returning to the particular case of FIGS. 1 to 4, receiving component 110 is a balance, and component 1 is a torsion wire. The invention provides a good solution for assembling a silicon component inside a metal component. In this case, the portion to be assembled, forming attachment area 2, is a substantially parallelepiped plate. Shell element 20 is formed here of two half-moon portions, forming first element 21 and second element 22, and which encase the silicon plate of attachment area 2. Attachment area 2 comprises, on either side and in a symmetrical manner, two flexible elements 6: 61, 62, which allow core 1 to be precisely positioned inside half-moon portions 21 and 22. These half-moon portions 21 and 22 are dimensioned such that one press fits inside the other, and they apply only compression stresses on silicon attachment area 2. In this manner, once the half-moon portions 21 and 22 are assembled on wire 1, the assembly holds itself together and is easy to handle. Once wire 1 has been covered by shell element 20 with the two half-moon portions 21 and 22, the entire assembly can be pressed into a receiving chamber 111, notably a bore in balance 110.

The positioning means 4 represented in FIGS. 1 to 4 allow for lateral positioning in the flat plane of attachment area 2 via elastic arms 61 and 62, and also axial positioning in the direction of wire 1, by bearing points 63 and 64 comprised in attachment area 2, and which are arranged to cooperate with corresponding surfaces 65 and 66 of first element 21, as seen in FIG. 3. These bearing points 63 and 64 may comprise flexible elements to ensure precise positioning.

Figure 8:
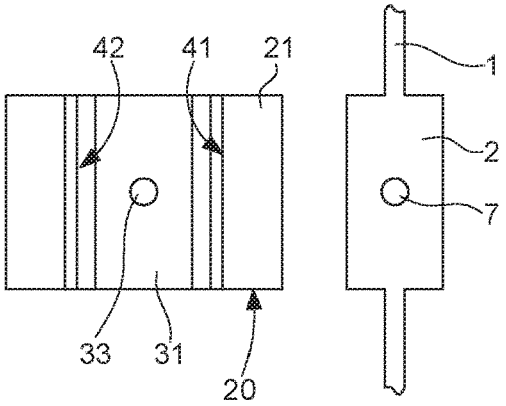
FIG. 8 shows a schematic side view of another sub-assembly with simplified positioning between the shell element and the component made of micromachinable material.

FIG. 8 summarises another simple positioning method, wherein attachment area 2 comprises a bore 7, arranged to cooperate with a trunnion or a pin 33 comprised in main complementary surface 31. Naturally, the reverse configuration is also achievable.

The method of assembly may be summarised as follows:

Component 1 made of micromachinable material, notably silicon, is enveloped in an intermediate component formed by a shell element 20, and the entire assembly is then pressed into a receiving component 110. Component 1 experiences only compression stress during the press fit, but no friction or displacement;

component 1 may comprise guide elements, for obtaining precise positioning;

the intermediate component or components, here the two half-moon portions 21 and 22, may form a self-supporting sub-assembly 10, prior to being pressed into receiving component 10.

The invention also concerns a timepiece movement 200 comprising at least one such assembly 100.

The invention also concerns a watch 300 including at least one such assembly 100.

The principle of the invention is applicable to other configurations of components, such as for example, the assembly of a silicon balance spring stud to a structure, or a silicon fixed pin or suchlike.

In short, owing to the invention, a component made of micromachinable material, notably silicon, can be press-fitted in another element. The invention may also be used for the assembly of certain fragile materials, such as glass, sapphire or suchlike, or for holding very thin microcomponents.

What is claimed is:

1. A timepiece sub-assembly comprising:

a timepiece component made of micromachinable material comprising at least one attachment area; and a shell element arranged to surround said at least one attachment area, said at least one attachment area comprising at least one peripheral contact surface, and said shell element being deformable with a geometry varying between a contracted shape and at least one expanded shape, and arranged to hold said at least one attachment area inside a housing contained in said shell element, and said shell element comprising at least one complementary contact surface configured to, in said contracted shape of said shell element, exert a clamping force on said at least one peripheral contact surface and firmly immobilize said at least one attachment area inside said shell element in all directions, wherein said shell element comprises at least a first element and a second element, movable with respect to each other in said at least one expanded shape, the first and second element comprising a first and second complementary contact surface, respectively, of said at least one complementary contact surface, and wherein said shell element comprises clamping means configured to hold at least said first element and second element clamped to each other in said contracted shape of said shell element.

2. The sub-assembly according to claim 1, wherein said at least one attachment area comprises at least one positioning surface, and wherein said shell element comprises at least one complementary positioning surface arranged to cooperate with said at least one positioning surface for the precise positioning of said at least one attachment area inside said housing contained in said shell element with at least one degree of freedom.

3. The sub-assembly according to claim 2, wherein at least one of said at least one attachment area comprises at least one elastic arm carrying a positioning surface of said at least one positioning surface for said timepiece component, arranged to cooperate in a complementary manner with a complementary positioning surface of said at least one complementary positioning surface comprised in a stiff portion of said shell element.

4. The sub-assembly according to claim 3, wherein said shell element comprises, in each said housing, stiff portions carrying two of said at least one complementary positioning surface which are parallel and opposite, forming a U-shape with a respective complementary contact surface of said at least one complementary contact surface, and wherein an attachment area of said at least one attachment area comprises two elastic arms, of said at least one elastic arm, which are symmetrical and opposite arranged to bear under stress on said two complementary positioning surfaces which are parallel and opposite at least in said contracted shape of said shell element.

5. The sub-assembly according to claim 1, wherein said shell element is in one-piece, and in that at least said first element and said second element comprised in said shell element are articulated to each other to allow an opening of said shell element for the insertion or the removal of said timepiece component, and, in said contracted shape of said shell element, to ensure that said timepiece component comprised in said sub-assembly is held clamped in position in an operating position of said sub-assembly.

6. The sub-assembly according to claim 5, wherein said shell element forms a sheath comprising said housing for said at least one attachment area of said timepiece component comprised in said sub-assembly, each of said at least one attachment area being, in said expanded shape of said at least one expanded shape, movable in an axial direction inside said housing thereof, and, in said contracted shape, enclosed in a substantially concentric manner inside said housing.

7. The sub-assembly according to claim 1, wherein at least said first element and said second element comprised in said shell element are independent of each other to allow an opening of said shell element for the insertion or the removal of said timepiece component, and have complementary profiles to ensure the relative clamping together thereof in said contracted shape of the shell element, and to ensure that said timepiece component comprised in said sub-assembly remains clamped in position in an operating position of said sub-assembly.

8. The sub-assembly according to claim 1, wherein said clamping means comprise at least one substantially annular peripheral component arranged to clamp together at least said first element and said second element.

9. The sub-assembly according to claim 1, wherein said clamping means comprise snap-fit means arranged to clamp together at least said first element and said second element, on which are disposed said snap-fit means.

10. The sub-assembly according to claim 1, wherein one of said first element and said second element comprises at least one element that is more flexible than a stiffer portion carrying one of said at least one complementary contact surface, forming said clamping means and arranged to elastically clamp the other of said first element and said second element.

11. The sub-assembly according to claim 1, wherein each of said at least one attachment area is plane and comprises two peripheral contact surfaces of said at least one peripheral contact surface which are parallel and opposite, and said shell element comprises said housing for receiving each of said at least one attachment area, said housing being delimited by said first complementary contact surface and said second complementary contact surface which are parallel and opposite.

12. A timepiece assembly comprising at least one receiving component and at least one sub-assembly according to claim 1, wherein said receiving component comprises a receiving chamber for each said sub-assembly, and wherein the inner surface of each said receiving chamber is arranged to receive an outer surface comprised in each said shell element of each said sub-assembly.

13. The timepiece assembly according to claim 12, wherein at least one said inner surface of said receiving chamber is dimensioned to compress said outer surface of said corresponding shell element upon the insertion of said corresponding sub-assembly into said receiving chamber, to cause said shell element to change from said at least one expanded shape to said contracted shape thereof upon said insertion.

14. A timepiece movement including at least one said timepiece assembly according to claim 12.

15. A watch including at least one said timepiece assembly according to claim 12.

16. The sub-assembly according to claim 1, wherein said clamping means is configured to hold said first element and said second element clamped to each other in said contracted shape of said shell element such that said at least one attachment area of said timepiece component becomes immobilized inside said shell element.

17. The sub-assembly according to claim 1, wherein said shell element is configured to directly sandwich, in a radial direction of said timepiece component, said timepiece component between said first complementary contact surface of said first element and said second complementary contact surface of said second element.

* * * * *